United States Patent [19]

Takegami et al.

[11] 4,442,173

[45] Apr. 10, 1984

[54] NOVEL WATER-ABSORBING ACRYLIC FIBERS

[75] Inventors: Shinsuke Takegami, Ootsu; Kaoru Ban; Mitsuru Wakitani, both of Okayama, all of Japan

[73] Assignee: Japan Exlan Company, Limited, Osaka, Japan

[21] Appl. No.: 387,682

[22] Filed: Jun. 11, 1982

Related U.S. Application Data

[62] Division of Ser. No. 231,626, Feb. 5, 1981, abandoned.

[30] Foreign Application Priority Data

Feb. 14, 1980 [JP] Japan ..... 55-17360

[51] Int. Cl.[3] ..... D02G 3/00

[52] U.S. Cl. ..... 428/372; 264/182; 428/394; 428/398

[58] Field of Search ..... 428/375, 376, 394, 398, 428/372; 264/182, 41

[56] References Cited

U.S. PATENT DOCUMENTS 4,272,422 6/1981 Tanaka .

4,316,937 2/1982 Tanaka et al. ..... 428/376

*Primary Examiner*—Lorraine T. Kendell

*Attorney, Agent, or Firm*—Wenderoth, Lind & Ponack

[57] ABSTRACT

Acrylic fibers consisting of not more than 90 weight % of an acrylonitrile polymer and less than 10 weight % of a water-absorbing resin having a particular cross-linking density, particle diameter and degree of water-swellability, which are excellent in practical properties such as strength, elongation, color fastness, spinnability and water-absorption.

12 Claims, No Drawings

NOVEL WATER-ABSORBING ACRYLIC FIBERS

CROSS-REFERENCE TO RELATED APPLICATION

This is a divisional application of application Ser. No. 231,626, filed Feb. 5, 1981, and now abandoned.

BACKGROUND OF THE INVENTION

1. Field of the Invention

The present invention relates to novel water-absorbing acrylic fibers, and more specifically relates to novel water-absorbing acrylic fibers compounded of a particular water-absorbing resin and provided with excellent practical properties such as dyeability, spinnability, strength and elongation.

2. Description of the Prior Art

Since acrylic fibers, like other synthetic fibers such as polyamide, polyester, etc. fibers, are lacking in water- and moisture-absorbing abilities, when used as material for underwear, sheeting, sportswear, summer wear, etc. it has been conventional practice in most cases to use them as mixed spun fabrics with cotton, rayon, etc. so that they can give a comfortable wearing feel.

Numerous trials have been made to imrove the water- and moisture-absorbing abilities of acrylic fibers, but to date none have been proposed having satisfactory properties.

For example, when producing acrylic fibers composed of a single component by wet-spinning, if the porous structure of the swollen gel filaments is fixed, acrylic fibers showing a water-absorbing ability can be obtained, but they involve intrinsic disadvantages that the micropores obtained by this method are unstable and will readily disappear in the subsequent drying step or by ironing, resulting in a lowered water-absorbing ability, extremely high absorption of spinning oil, and poor color fastness.

Many proposals have been made on methods of producing micropores in the filaments by spinning a spinning solution to which a specified inorganic or organic substance has been added, and thereafter removing the added substance. However, such methods will pose essential problems including pollution of solvent by said substance or aggravation of working environment, complication of the production process such as the recovery of said substance, and therefore such methods cannot be evaluated as industrially advantageous methods.

Several techniques have been also proposed in which water- and moisture-absorbing abilities are given to acrylic fibers by partially hydrolyzing the fibers. However, such fibers having a large amount of carboxyl group introduced to the fiber surface will show a remarkable decrease in the physical properties and color fasteness, and also will not be able to avoid a sticky feel when they have absorbed water. Therefore such methods are not satisfactory means in practical use.

STATEMENT OF THE INVENTION

Under such circumstances, we made an intensive study to eliminate the above-mentioned disadvantages and to provide novel water-absorbing acrylic fibers in an industrially advantageous manner. As a result, we have found that, by compounding a particular water-absorbing resin and adding a specified amount of spinning oil to the fibers, it is possible to produce novel water-absorbing acrylic fibers having excellent practical properties such as color fastness, spinnability, strength and elongation, without problems in the production process, such as spinnerette clogging, filament breakage, filament entanglement, filament fusion, etc. This finding led us to the present invention.

Therefore, an object of the present invention is to provide a novel water-absorbing acrylic fibers which have a stable water-absorbing ability that will not be readily lowered by heat treatment, etc. and which are excellent in physical properties such as strength and elongation and in practical properties such as color fastness, spinnability, etc. Another object is to provide an industrially advantageous means for producing water-absorbing fibers which are free from any sticky feel upon water absorption, without problems in production such as spinnerette clogging, filament breakage, filament entanglement, filament fusion, and also without problem in the recovery of the added substance, aggravation of working environment, etc.

The water-absorbing acrylic fibers which can attain the above-mentioned objects of the present invention are composed of more than 90 weight % of a polymer of acrylonitrile (hereinafter abbreviated as AN) and less than 10 weight % of a water-absorbing resin, which fibers contain fixed thereto a spinning oil in an amount not more than 1.5% by weight of the fibers, and have a surface resistance of not larger than $1\times10^9\Omega$ and a water-holding ratio not less than 25%, the decrease in the water-holding ratio of the fibers after dry-heat treatment at 120° C. for one hour being not more than 10%, said water-absorbing resin having 1–15 cross-linkages for 400 repeating units of the polymer constituting said resin, and having a particle diameter not larger than $0.5\mu$ in absolute dryness and a water-swelling ability of from 20 to 300 c.c./g.

DESCRIPTION OF PREFERRED EMBODIMENTS

The present invention will be explained in detail. Firstly, as the AN polymers of the present invention, any of those used in the production of acrylic fibers known heretofore may be used, and no limitation is placed on the polymer. However, it is preferable to use a copolymer of not less than 60 weight %, more preferably not less than 90 weight %, of AN and the remainder of another vinyl monomer, from the viewpoint of fiber physical properties, dyeability, etc.

Secondly, there will be explained the water-absorbing resins to be compounded in the above-mentioned AN polymers.

As such resins, any resins may be employed so far as they have 1–15, preferably 2–10 cross-linkages, for 400 repeating units of the polymer constituting the resin, a particle diameter of not larger than $0.5\mu$, preferably not larger than $0.2\mu$, and a water swellability of 20–300 c.c./g, preferably 30–150 c.c./g, and are insoluble in water and in solvents for AN polymers.

As the compounding ratios of such water-absorbing resins, it is necessary that they are less than 10 weight %, preferably in the range of 1–6 weight %. If the ratio is out of the lower limit of the range, it will be impossible to give a sufficient water-absorbing ability to the fibers to be finally obtained, and if the ratio exceeds the upper limit of the range, it will be impossible to avoid such problems as filament breakage upon filament spinning.

In order to attain the objects and effects of the present invention, it is necessary that the ratio of the cross-linkages in the water-absorbing resin (cross-linking density), the particle diameter and the degree of water-swellability should be decided within the recommended ranges in the present invention. Only on the condition that a water-absorbing resin satisfying such characteristics should be employed, it is possible to produce water-absorbing acrylic fibers having excellent practical properties in an industrially advantageous manner, without any problems in the production process. The cross-linking density not only plays an important role of regulating the degree of water-swellability of the water-absorbing resin, but also, in cooperation with the specified particle diameter, it has an important relation with the spinnability of the spinning solution of the AN polymer compounded of said resin. Only the use of a water-absorbing resin having a cross-linking density recommended in the present invention makes it possible to produce fibers having sufficient strength, elongation, water-absorption, etc., without any problems in the production such as spinnerette clogging, filament breakage, etc. Furthermore, the water-swelling characteristic of said resin plays an important role in the water-absorbing ability of the fibers obtained, and only in the case where a resin having a water-absorbing ability recommended in the present invention is used, it is possible to obtain a satisfactory spinnability of the spinning solution and satisfactory physical properties such as strength and elongation, and practical properties such as spinnability of the finally obtained fibers.

No limitation is placed on methods of producing such a water-absorbing resin if the above-mentioned characteristics recommended in the present invention are satisified. However, the following method will be useful in that it can produce a resin having such characteristics in an industrially advantageous manner.

When a cross-linked AN copolymer having a particle diameter of not larger than $0.5\mu$, preferably not larger than $0.2\mu$, which is composed of preferably not less than 50 weight %, more preferably not less than 70 weight %, of AN, based on the total amount of the monomers composing the polymer, and definite amounts of a cross-linking monomer and another vinyl monomer copolymerizable with AN, or an aqueous dispersion of such a cross-linked AN copolymer, is acted, in the usual way, with an alkaline substance so as to introduce carboxyl groups into said copolymer, it is possible to produce, in an industrially advantageous manner, a resin having a degree of water-swellability of 20–300 cc/g, preferably 30–150 cc/g or an aqueous dispersion of said resin. In the case where such a water-absorbing resin is produced or used in the form of an aqueous dispersion, and when the aqueous dispersion has the following relation formula (1), the whole of the aqueous dispersion solidifies in the form of jelly, and therefore it is preferable to make the resin to shrink so that it can maintain the form of an aqueous dispersion, by such a means as to cause a water-miscible organic solvent or an electrolytic salt to coexist beforehand in the medium to be alkali-treated.

$$C \times S \geqq W \quad (1)$$

wherein C is the concentration (% by weight) of the water-absorbing resin in the aqueous dispersion, S is the degree of water-swellability (cc/g) of the water-absorbing resin, and W is the ratio (% by weight) of water in the aqueous dispersion.

As the above-mentioned cross-linking monomers, there may be mentioned cross-linking monomers having two or more copolymerizable double bonds in the molecule, such as for example diesters, triesters or tetraesters of acrylic acid or methacrylic acid, allyl esters of unsaturated carboxylic acids, diallylesters of polyvalent carboxylic acids, divinyl acid anhydrides, divinyl sulfone, methylenebisacrylamide, divinylbenzene and its alkyl- or halogen-substituted products and/or cross-linking monomers having at least one epoxy group in the molecule, such as glycidyl esters or unsaturated glycidyl ethers of the above-mentioned unsaturated carboxylic acids or unsaturated sulfonic acids. By using such a cross-linking monomer as the copolymerization component so as to cause it to cross-link during or after polymerization, the cross-linkage can be easily obtained. Among others, it is desirable to use, as the copolymerization component, cross-linking monomers having two or more copolymerizable double bonds in the molecule and being highly resistant to alkali, such as divinyl sulfone, methylenebisacrylamide, divinylbenzene, etc.

As regards the production of the above-mentioned cross-linked AN copolymers having the fine particle diameters, it can be advantageously carried out by employing, for example, the process disclosed in U.S. Pat. No. 4,130,525, filed by the same applicant as that of the present invention.

By using, as such a water-absorbing resin, a resin in which a cross-linked AN copolymer coexists, the miscibility with the fiber-forming matrix polymer (AN polymer) or the spinnability can be further improved. There is no limitation on the methods of producing a water-absorbing resin in which a cross-linked AN polymer coexists, but the water-absorbing resin can be advantageously produced by suitably selecting the vinyl monomer composing the cross-linked AN copolymer or by regulating the hydrolytic condition so as to partially hydrolyze only the surface layer of the cross-linked AN copolymer, leaving the unreacted portion of the copolymer, or by grinding down the remaining resin particles of the core portion by means of a colloid mill, ball mill, etc. so that at least a part of the cross-linked AN copolymer will be exposed on the surface of the water-absorbing resin.

A method of producing the water-absorbing acrylic fibers of the present invention will be explained in the following. As such a method any methods can be employed so far as fibers having the properties aimed at in the present invention can be obtained. However, in order to obtain such fibers in an industrially advantageous manner, it is desirable to employ the following method.

A spinning solution is prepared by dissolving an AN polymer in a known solvent. After a water-absorbing resin, preferably a predetermined amount of an aqueous dispersion of said resin, is mixed with said spinning solution, the spinning solution is wet-spun, and the resulting fibers are washed with water and stretched. The stretched gel fibers thus obtained are then subjected to a drying-compacting treatment, if desired, and to wet-heat relaxing treatment, preferably followed by a drying treatment in the range of from 105° to 170° C.

As the aqueous dispersion of the water-absorbing resin to be suitably compounded in the spinning solution, it is desirable to use an aqueous dispersion of a resin concentration of from 2 to 20 weight %, preferably from 5 to 10 weight %, and further to use one having a viscosity of less than 300 cp prepared by adding to said aqueous dispersion, a part of the organic or inorganic solvent for preparing the spinning solution and/or another inorganic salt (Glauber's salt, sodium nitrate, etc.), because the dispersibility of said dispersion to the spinning solution and the spinnability of the resulting spinning solution can then be still more improved.

As regards the above-mentioned wet-heat relaxing treatment, it is necessary that said treatment should be carried out in a hot water medium or in a saturated or superheated steam atmosphere under such a condition that the fibers after said treatment will have a water-holding ratio increased by 1.5 times. Only after such a wet-heat treatment has been carried out, it is possible to attain enlargment and fixation of the pores present in the fibers and improvement in the water-absorbing ability resulting from the generation of pores passing to the outside of the fibers, as well as to provide acrylic fibers remarkably improved in physical properties such as strength, elongation, etc. and in color fastness. The condition of such wet-heat treatment will vary depending on the kind of the AN polymer (the starting material) and water-absorbing resin, and on the spinning condition, and therefore it is difficult to prescribe it definitely. However, it is especially desirable to employ a temperature condition above 110° C., preferably above 120° C., in a saturated steam atmosphere because a remarkable effect can be obtained in a short time.

It is of course possible to composite-spin in the usual way at least two kinds of spinning solutions (one of which is a spinning solution compounded of water-absorbing resin and the other is a spinning solution containing no water-absorbing resin) into the form of sheath-core type, side-by-side type, sandwich type, random composite type, sea-and-islands type, etc. so that, for example, at least a part of the AN polymer containing no water-absorbing resin will be exposed on the fiber surface.

As for the water-absorbing acrylic fibers of the present invention thus produced, it is necessary that said fibers should contain a spinning oil in an amount of not more than 1.5%, preferably in the range of from 0.1 to 1.0% based on the weight of the fibers, and moreover should have a surface resistance of not larger than $1\times10^9\Omega$, preferably not larger than $5\times10^8\Omega$. In the case of fibers which do not satisfy the recomended ranges of the content of spinning oil and the surface resistance, it is not only impossible to avoid troubles during spinning, but also there is obtained only a product inferior in color fastness to sweat, washing and wet-rubbing, so that such fibers cannot be formed into a practical product. As such spinning oils, there may be mentioned, for example, anionic surface-active agents such as neutralized salts of higher alcohol sulfuric acid esters, neutralized salts of higher alcohol phosphoric acid esters, neutralized salts of polyoxyethylene higher alcohol ether phosphoric acid esters, etc.; and nonionic surface-active agents such as higher alcohol ethylene oxide addition products, fatty acid ethylene oxide addition products, alkylphenol ethylene oxide addition products, etc. As regards the process for applying said oils, it can be suitably carried out after stretching, after drying-compacting, or at the same time with or after the wet-heat relaxing treatment.

It is necessary that the fibers according to the present invention should have a water-holding ratio of not less than 25%, preferably not less than 30%, and only such fibers can manifest a water-absorbing ability comparable to cotton.

In addition, it is necessary that the fibers according to the present invention should have a decrease in the water-holding ratio, after dry-heat treatment at 120° C. for one hour, of not more than 10%, preferably not more than 5%. If the decrease in the water-holding ratio exceeds the recommended limit of the present invention, there will be a remarkable decrease in the water-absorbing ability during higher order processing steps or during practical use, so that such fibers will suffer numerous limitations.

The above-mentioned water-absorbing acrylic fibers, only after being compounded of the water-absorbing resins having a specified cross-linking density, particle diameter and water-swelling characteristic, are given the excellent water-absorbing ability while retaining excellent physical properties such as strength, elongation, etc. and practical properties such as spinnability, color fastness, etc. The pores formed by compounding such a resin are very stable and do not readily disappear as is the case with microporous acrylic fibers, so that there is no substantial decrease in the water-absorbing ability. Furthermore, since the fiber structure is compacted while maintaining the pores in the fibers, the fibers are excellent in physical properties such as strength and elongation, and in practical properties such as color fastness against sweat, washing and wet rubbing. Moreover, the fiber can have excellent spinnability since the surface resistance of the fibers can be effectively decreased by the application of a small amount of spinning oil, whereas the fibers have pores passing to the exterior of the fibers. In addition, the water-absorbing acrylic fibers according to the present invention can easily control the water-absorbing ability by varying the amount, kind, etc. of the water-absorbing resin to be compounded. Also, the water-absorbing fibers of the present invention are free from any troubles in the production, such as spinnerette clogging, filament breakage, entanglement and fusion, and free from the disadvantage of absorbing a large amount of spinning oil as is the case with the conventional existing microporous, water-absorbing acrylic fibers. Thus the fibers of the present invention have many industrial advantages.

The acrylic fibers of the present invention having many advantages in the production process and in practical properties can be used singly or in mixture with various synthetic fibers sold on the market, such as polyester, polyamide, polyacrylic or modacrylic fibers, as material for comfortable underwear, sheeting, toweling, sportswear, summer clothing, etc.

In the following, the effect produced by the present invention will be explained in further detail by way of examples wherein parts and percentages are by weight unless otherwise indicated.

The water-swellability of the water-absorbing resin, the water-holding ratio of the fibers, the decrease in the water-holding ratio and the surface resistance in the following examples were measured and calculated according to the following methods.

(1) Degree of water-swellability (cc/g)

About 0.5 gram of water-absorbing resin is immersed in pure water at 25° C. After 24 hours, the water-absorbing resin in a water-swollen state is placed between pieces of filter paper to remove excess water held among the resin particles. The weight ($W_1$) of the sample thus prepared is measured. The sample is then dried in a vacuum drier at 80° C. until it reaches a constant weight ($W_2$). From the above measurement results, the degree of water-swellability is calculated by the following formula:

$$\text{Degree of water-swellability} = \frac{W_1 - W_2}{W_2}$$

(2) Water-holding ratio (%)

About one gram of sample fibers cut in about 5 cm lengths and sufficiently opened is immerses in pure water at 25° C. After 20 minutes, the water held among the fibers is removed by a centrifuge (produced by Kokusan-Enshinki Co. Ltd.; radius 12 cm) at a rotation of 2,000 rpm. The weight ($w_1$) of the sample thus prepared is measured. The sample is dried in a vacuum drier at 80° C. until it reaches a constant weight ($w_2$). From the above measurement results, the water-holding ratio is calculated by the following formula:

$$\text{Water-holding ratio} = \frac{w_1 - w_2}{w_2} \times 100$$

(3) Decrease in water-holding ratio (%) is calculated from the following formula:

$$\text{Decrease in water-holding ratio} = X_o - X$$

wherein X is the water-holding ratio of the sample fibers dry-heat treated at 120° C. for one hour, and $X_o$ is the water-holding ratio of the sample fibers which have not been subjected to said dry-heat treatment.

(4) Surface resistance (Ω) is a value measured by means of a fiber electroconductivity measuring apparatus TEXTROHM (produced by Chuo Denshi Kogyo Co. Ltd.) in an atmosphere at a temperature of 20° C. and at a relative humidity of 65%.

EXAMPLE 1

Seventy-six parts of AN, 20 parts of methyl acrylate (MA), 2 parts of methylenebisacrylamide (MBA), 2 parts of sodium p-styrene sulfonate (SpSS), and 233 parts of water were charged into an autoclave of a 2-liter capacity. As the polymerization initiator, 0.5% of di-tert-butyl peroxide based on the total of the monomers, was further added, and the autoclave was closed tightly. The polymerization was carried out at 150° C. for 20 minutes under stirring. After the completion of the reaction, the stirring was continued to cool to about 90° C. Thereafter, the resulting product was taken out of the autoclave. The polymer particles dispersed in this cross-linked AN copolymer emulsion had a particle diameter of 0.1μ.

Twenty parts of the above-mentioned emulsion (a) prepared so as to be 25% in polymer concentration was added to 80 parts of a 3% aqueous sodium hydrate solution, to carry out alkali treatment at 95° C. for 30 minutes under stirring. The thus-obtained water-absorbing resin (A) had a core of the cross-linked AN polymer, and had a particle diameter of 0.1μ and a degree of water-swellability of 70 cc/g.

This aqueous dispersion of the water-absorbing resin (regulated to have a viscosity of 100 cp by adding sodium thiocyanate) was added to a spinning solution consisting of 10 parts of an AN polymer (having an inherent viscosity [η] of 1.3 in dimethylformamide at 30° C.) composed of 90% AN, 9.7% MA and 0.3% sodium methally sulfonate (SMAS) and 90 parts of a 50% aqueos sodium thiocyanate solution so that the water-absorbing resin was 3% based on the total amount of the AN polymer and the water-absorbing resin. The particles of the water-absorbing resin were uniformly dispersed without agglomeration in the spinning solution. The spinning solution was then wet-spun in the usual way through a spinnerette having orifices of a 0.075 mm diameter. The spinning, coagulation, water-washing and stretching could be carried out satisfactorily without problems such as spinnerette clogging, filament breakage, etc.

After drying-compacting the resulting fibers at 120° C. for 20 minutes, the fibers were subjected to a wet-heat relaxing treatment in saturated steam at 125° C. for five minutes. Thereafter, an anionic surface-active agent Mapol 100 (produced by Matsumoto Oil and Fat Co. Ltd.) was added to the fibers so that the fibers contained 0.4%, and the fibers were dried at 110° C. for 10 minutes.

The thus-obtained fibers (I) had a surface resistance of $2\times10^8\Omega$, a water-holding ratio of 45% and a decrease in water-holding ratio of 10%. The fibers also had strength and elongation characteristics (dry strength 3.4 g/d; dry elongation 40%) comparable to those of the ordinary acrylic fibers.

The fibers (I) dyed with a dyestuff Aizen Cathilon Blue GLH (produced by Hodogaya Chemical Co. Ltd.) were tested for color fastness to sweat according to the JIS L-0848-1965 A method (stains to silk under an alkaline condition) and the color fastness was found to be Class 4. The spinability of the fibers (I) was also good.

Fibers (II) which were not subjected to the wet-heat relaxing treatment and the following in the production process of the fibers (II) had a water-holding ratio of 18% and the water-absorbing ability was insufficient.

Microporous acrylic fibers (III) was produced according to the process of producing the fibers (I) (the wet-heat relaxing treatment temperature 110° C.; the drying temperature 100° C.) except that the water-absorbing resin was not added and the drying-compacting step was omitted. The water-holding ratio of the fibers (III) was 35%, but the decrease in water-holding ratio amounted even to 22%. Also, the fibers after addition of 1.5% spinning oil had a surface resistance of $3\times10^{12}\Omega$, so that the spinning was impossible. The color fastness was also very low (Class 2).

EXAMPLE 2

Four kinds of water-absorbing resins (B–E) having a cross-linked AN polymer core, shown in Table 1, were prepared according to the process described in Example 1. All these resins had an average particle diameter of about 0.1μ.

TABLE 1

| Sample no. | Cross-linked AN copolymer No. | Cross-linked AN copolymer Monomer composition | Degree of water-swellability (cc/g) |
|---|---|---|---|
| B | b | AN/MMA/MBA/SpSS = 77.8/20/0.2/2 | 350 |
| C | c | AN/MA/MBA/SpSS = 73/20/5/2 | 42 |
| D | d | AN/MA/DVB/SpSS = 70/20/8/2 | 22 |
| E | e | AN/MMA/DVB/SpSS = 68/20/10/2 | 10 |

Note:
MMA = methyl methacrylate
DVB = divinylbenzene

Using these four kinds of water-absorbing resins (B–E) and according to the process described in Example 1, four kinds of sample fibers (IV–VII) were produced.

The water-holding ratio and the decrease in water-holding ratio of the thus-obtained fibers were measured and the results are shown in Table 2.

TABLE 2

| Sample no. | Kinds of water-absorbing resin No. | Degree of water-swellability(cc/g) | Water-holding ratio (%) | Decrease in water-holding ratio (%) |
|---|---|---|---|---|
| IV | B | 350 | 56 | 3 |
| V | C | 42 | 41 | 2 |
| VI | D | 22 | 24 | 3 |
| VII | E | 10 | 16 | 4 |

As apparent from the results in Table 2, the fibers (VII) produced by using the water-absorbing resin (E) having a water-swellability less than the range recommended in the present invention had an insufficient water-absorbing ability. In the case of the fibers (IV) produced by using the water-absorbing resin (B) having a water-swellability exceeding the recommended range, the water absorbing ability was large, but there was frequent fiber breakage during the spinning process, and therefore it was impossible to obtain satisfactory fibers. Also, in the case of the fibers (VI) produced by using the water-absorbing resin (D) having a cross-linking density exceeding the range recommended in the present invention, the water-absorbing ability was somewhat low and the spinnability was poor.

As opposed thereto, in the case of the fibers (V) produced according to the present invention, there were no troubles in the spinning process, and the fibers had an excellent water-absorbing ability and a good spinnability.

EXAMPLE 3

Four kinds of sample fibers (VIII–XI) were produced according to the process described in Example 1 using the water-absorbing resin (A) described in Example 1, except that the compounded amounts of the resin were varied as shown in Table 3.

The results of measuring the water-holding ratio of these fibers are given in Table 3.

TABLE 3

| Sample no. | Compounded amount of water-absorbing resin (%) | Water-holding ratio (%) |
|---|---|---|
| VIII | 0.5 | 19 |
| IX | 2.0 | 36 |
| X | 5.0 | 54 |
| XI | 10.5 | — |

As apparent from the results in Table 3, in the case of the fibers (VIII) whose amount of compounded resin was less than the range recommended in the present invention, the water-absorbing ability was insufficient, and also in the case of the fibers (XI) whose amount of compounded resin exceeded the recommended range, there were frequent spinnerette clogging and filament breakage, and therefore it was impossible to obtain fibers satisfactory for practical use. As opposed thereto, in the case of the fibers (IX and X) produced according to the present invention, both spinnability and water-absorbing ability were excellent.

What is claimed is:

1. Water-absorbing acrylic fibers consisting of more than 90 weight % on an acrylonitrile polymer and less than 10 weight % of a water-absorbing resin, which fibers have a surface resistance not larger than $1\times10^9\Omega$ and a water-holding ratio not less than 25%, the decrease in the water-holding ratio of the fibers after a dry heat treatment at 120° C. for one hour being not more than 10%, and which fibers are produced by the steps of wet-spinning a spinning solution of an acrylonitrile polymer mixed with a water-absorbing resin, water-washing and stretching the resulting fibers, dry-compacting the fibers if desired, subjecting the fibers to a wet-heat relaxing treatment, imparting to the fibers less than 1.5%, by weight of the fibers, of a spinning oil, and drying the fibers in a temperature range of from 105° to 170° C., said water-absorbing resin having 1 to 15 cross-links for 400 repeating units of the polymer forming said resin, and being a resin having a particle diameter less than 0.5μ in absolute dryness and a degree of water-swellability within the range of from 20 to 300 cc/g.

2. The water-absorbing acrylic fibers as claimed in claim 1 wherein the acrylonitrile polymer is a copolymer of not less than 80 weight % acrylonitrile and the remainder % of another vinyl monomer.

3. The water-absorbing acrylic fibers as claimed in claim 1 wherein the water-absorbing resin is a resin in which a cross-linked acrylonitrile copolymer coexists.

4. The water-absorbing acrylic fibers as claimed in claim 1 wherein the compounded ratio of the water-absorbing resin is from 1 to 6 weight %.

5. The water-absorbing acrylic fibers as claimed in claim 1 wherein the wet-heat relaxing treatment is carried out at a temperature of above 110° C. in a saturated steam atmosphere.

6. The water-absorbing acrylic fibers as claimed in claim 1 wherein the wet-heat relaxing treatment is carried out at a temperature above 120° C.

7. A process of producing water-absorbing acrylic fibers consisting of more than 90 weight % of an acrylonitrile polymer and less than 10 weight % of a water-absorbing resin, which fibers have a surface resistance not larger than $1\times10^9\Omega$ and a water-holding ratio not less than 25%, the decrease in the water-holding ratio of the fibers after a dry heat treatment at 120° C. for one hour being not more than 10%, said process comprising the steps of wet-spinning a spinning solution of an acrylonitrile polymer mixed with a water-absorbing resin, water-washing and stretching the resulting fibers, dry-compacting the fibers if desired, subjecting the fibers to a wet-heat relaxing treatment, imparting to the fibers less than 1.5%, by weight of the fibers, of a spinning oil, and drying the fibers in a temperature range of from 105° to 170° C., said water-absorbing resin having 1 to 15 cross-links for 400 repeating units of the polymer forming said resin, and being a resin having a particle diameter less than 0.5μ in absolute dryness and a degree of water-swellability within the range of from 20 to 300 cc/g.

8. A process according to claim 7 in which the wet-heat relaxing treatment is carried out at a temperature of above 110° C. in a saturated steam atmosphere.

9. The process according to claim 7 in which the wet-heat relaxing treatment is carried out at a temperature above 120° C.

10. The process according to claim 7 in which the acrylonitrile polymer is a copolymer of not less than 80 weight % acrylonitrile and the remainder % of another vinyl monomer.

11. The process according to claim 7 in which the water-absorbing resin is a resin in which a cross-linked acrylonitrile copolymer coexists.

12. The process according to claim 7 in which the compounded ratio of the water-absorbing resin is from 1 to 6 weight %.

* * * * *